United States Patent [19]

Brunner et al.

[11] Patent Number: 4,941,605

[45] Date of Patent: Jul. 17, 1990

[54] PRESSURE AIR TOOL FOR BLOWING THREADS INTO THREAD GUIDING PIPES

[75] Inventors: Heinz Brunner, Albstadt-Ebingen; Waldemar Pschellok, Albstadt-Tailfingen, both of Fed. Rep. of Germany

[73] Assignee: Sipra Patententwicklungs-und Beteiligungsgesellschaft mbH, Albstadt-Tailfingen, Fed. Rep. of Germany

[21] Appl. No.: 243,446

[22] Filed: Sep. 12, 1988

[30] Foreign Application Priority Data

Sep. 16, 1987 [DE] Fed. Rep. of Germany ..... 3731108
Feb. 1, 1988 [DE] Fed. Rep. of Germany ..... 3802843

[51] Int. Cl.[5] ..... B65H 20/14
[52] U.S. Cl. ..... 226/97
[58] Field of Search ..... 226/97; 251/149.1, 149.6, 251/149.7; 239/587, 583, 569, 579, 600; 57/279, 280

[56] References Cited

U.S. PATENT DOCUMENTS

| | | | |
|---|---|---|---|
| 3,741,521 | 6/1973 | Tatsuno | 251/149.7 |
| 3,806,086 | 4/1974 | Cloyd | 251/149.7 |
| 4,143,853 | 3/1979 | Abramson | 251/149.1 |
| 4,156,503 | 5/1979 | Norén | 239/587 X |
| 4,323,196 | 4/1982 | Logue et al. | 239/587 X |
| 4,610,469 | 9/1986 | Wolff-Mooij | 251/149.1 X |

FOREIGN PATENT DOCUMENTS

| | | | |
|---|---|---|---|
| 0146898 | 7/1985 | European Pat. Off. | 57/279 |
| 855804 | 7/1949 | Fed. Rep. of Germany | 239/588 |
| 527570 | 3/1955 | Italy | 239/587 |
| 1517314 | 7/1978 | United Kingdom | 239/588 |

*Primary Examiner*—Stuart S. Levy
*Assistant Examiner*—Paul T. Bowen
*Attorney, Agent, or Firm*—Michael J. Striker

[57] ABSTRACT

A pressure air tool for blowing threads into thread guiding pipes comprises an air guiding passage having two ends, a handle provided on the air guiding pipe, and a blowing head provided on one of the ends of the air guiding pipe, the blowing head being connected with the air guiding pipe so that its blowing direction is adjustable.

4 Claims, 4 Drawing Sheets

PRESSURE AIR TOOL FOR BLOWING THREADS INTO THREAD GUIDING PIPES

BACKGROUND OF THE INVENTION

The present invention relates to a pressure air tool for blowing threads into a thread guiding pipe. More particularly it relates to such a pressure air tool which has air guiding passage with a valve, a handle provided on the air guiding passage, and a blowing head provided on one end of the air guiding passage and having thread introducing slots.

Pressure air tools of the above mentioned general type are known in the art. A known pressure air tool has the disadvantage that the blowing head extends in the longitudinal direction of the air guiding pipe or under an angle to the longitudinal direction of the air guiding pipe in a fixed manner. Since the openings of thread guiding pipes in rinsing frames or on textile machines are arranged at different heights, an operator is forced because of the rigid arrangement of the blowing head to assume for blowing a thread into the thread guiding pipe a position which depends on the height of the thread guiding pipe opening. As a result of this, he can be forced to kneel for reaching the thread guiding opening with the pressure air tool.

SUMMARY OF THE INVENTION

Accordingly, it is an object of the present invention to provide a pressure air tool which avoids the disadvantages of the prior art.

More particularly, it is an object of the present invention to provide a pressure air tool which facilitates respective works for personnel.

In keeping with these objects and with others which will become apparent hereinafter, one feature of the present invention resides, briefly stated, in a pressure air tool in which a blowing head is arranged on the air guiding pipe so that its blowing direction is adjustable. Advantageously, the blowing head is supported on the air guiding pipe internally in at least one plane, and for this purpose is coupled with an adjusting member arranged on the handle.

When the pressure air tool is designed in accordance with the present invention, the operator is in the position which is normal and provides for a convenient standing, and at the same time the blowing head can be arranged both so that it is in alignment with a low thread guiding pipe opening and a high thread guiding pipe opening, since the blowing head can be oriented in a corresponding fashion.

The orientation of the blowing head can be performed by means of an adjusting member which is arranged on the handle, through a linkage or at least one probe which connects the blowing head with the adjusting member. Advantageously, the adjustable arrangement of the blowing head can be performed by coupling with the air guiding pipe by means of an elastic hose portion. Such an elastic hose portion can be designed as a simple hinge connection which allows turning to all sides. For the utilization, it is generally sufficient to provide an adjustment in a single plane, in which the blowing head can be guided by the parts mounted on the air guiding pipe. It is advantageous when the blowing head can be turned over a region of maximum 90° and urged by a return spring.

The valve which is arranged in the guiding passage can be mounted in the handle and actuated by hand. In accordance with a preferable embodiment, the valve however is mounted in the blowing head and is automatically openable. The pressure air valve opens automatically as long as the blowing head is placed against the opening of the thread guiding pipe. For this purpose the blowing head opening is expanded so as to form a receiving space for the end of the thread guiding pipe, and provided with a sensor which is coupled with a valve member and acted upon in the receiving space by a thread guiding pipe end. A special gripping lever for actuating the pressure air valve by an operator is therefore dispensed with. The facilitation of the handling of pressure air tool, which is obtained by the automatically openable pressure air valve, is especially important for pressure air tools with a blowing head having an adjustable blowing direction, which adjustment is performed by an operating lever on the handle of the tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2:
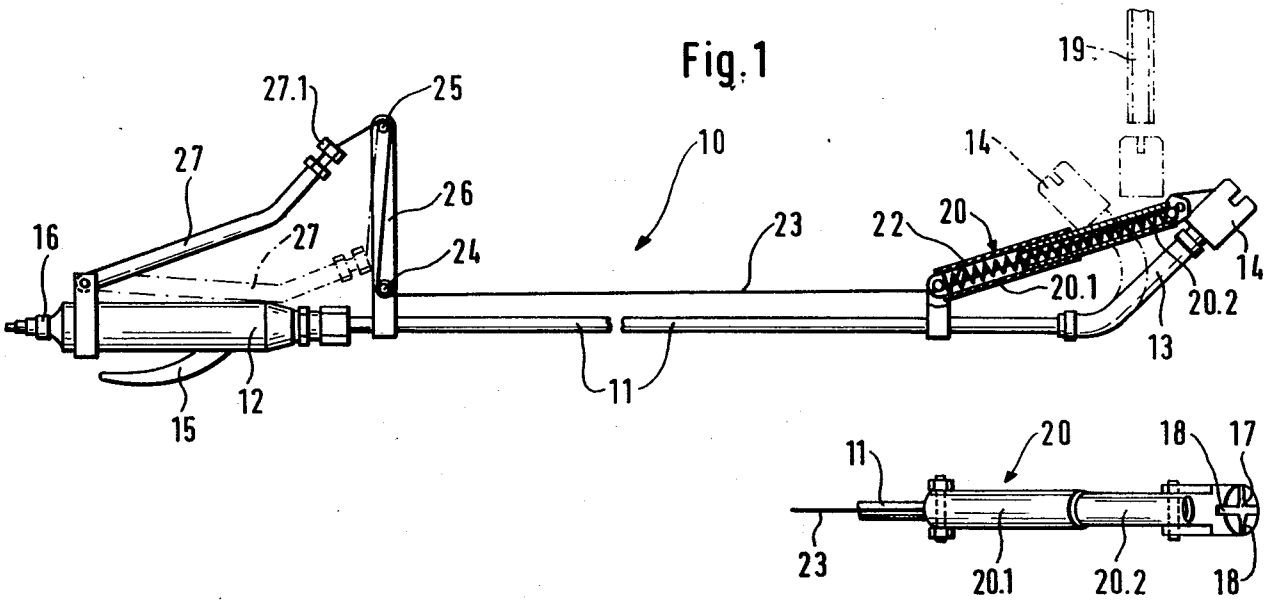
FIG. 1 is a side view of a pressure air tool in accordance with one embodiment of the present invention.
FIG. 2 is a partial view of the pressure air tool of FIG. 1 at the end of the blowing head, turned by 90°.

A pressure air tool 10 shown in FIGS. 1 and 2 has an air guiding pipe 11. The air guiding pipe is provided on its one end with a handle 12 and on its other end with a blowing head 14 which is mounted through a flexible hose piece 13. The handle 12 has a not shown pressure air valve which is actuated by a pressure lever 15. The pressure air valve is connected at its one side with a pressure air supply connection 16 mounted on the handle 12 and on its another side with the air guiding pipe 11. The blowing head 14 is provided on its free end which is shown in FIG. 2 with a blowing opening 17 and with slots 18 which extend radially to the blowing opening 17. A thread is introduced into the slots 18 and must be blown into a thread guiding pipe 19 shown in FIG. 1.

The position of the blowing head 14 is determined by a telescopable rod 20 which is composed of two tubular portions 20.1 and 20.2 displaceable into one another. One tubular portion 20.1 is articulately connected with a holding part 21 mounted on the air guiding pipe 11, while the other tubular portion 20.2 is articulately connected with the blowing head 14. As shown in the section of the telescopable bar 20 in FIG. 1, a helical or screw-shaped return spring 22 is arranged in its interior. It urges the blowing head 14 to a position which is shown in solid lines in FIG. 1.

The blowing nozzle 14 can be turned from the position shown in FIG. 1 over up to 90° by means of a pulling rope 23 which extends through the hollow telescopable rod 20 and is connected at its end to the blowing head 14. The pulling rope 23 extends along the air guiding pipe 11, then over two deviating rollers 24 and 25 of a transverse arm 26 which is mounted on the air guiding pipe 11, and is connected with its another end to a free end 27.1 of a turning lever 27 which is mounted on the handle 12. The turning lever 27 can move from the initial position shown in FIG. 1 by the hand of an operator placed on the handle 12, over any distance until it reaches a maximum position shown in broken lines with respect to the handle 12. In the maximum position it forms a maximum turning angle of 90° with the blowing head 14.

The pressure air guiding connection 16 can be connected either with a pressure air source through a pressure air hose or with a pressure air cartridge.

Figure 3:
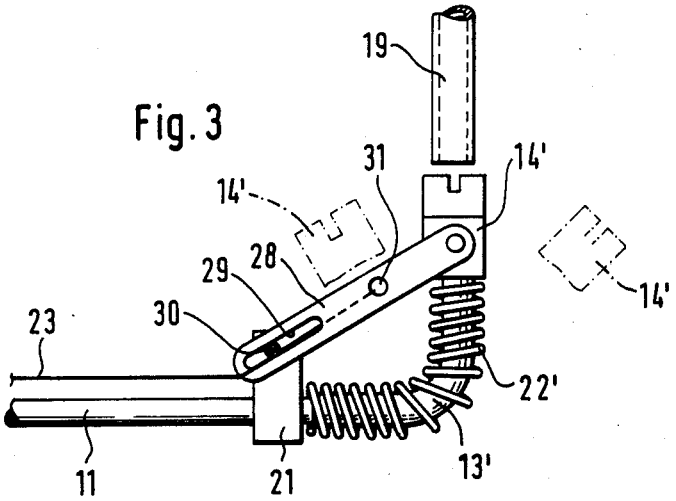
FIG. 3 is a view of the blowing head end of a pressure air tool in accordance with the second embodiment of the invention.
Figure 4:
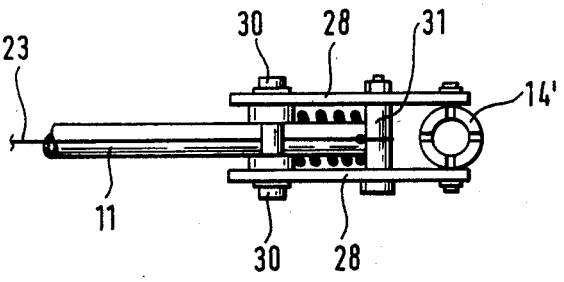
FIG. 4 is a view showing a part of the pressure air tool in FIG. 3, which is turned by 90° relative to the view of FIG. 1.

In the embodiment shown in FIGS. 3 and 4, the telescopable rod 20 is replaced by a pair of coulisse levers 28 which are pivotally connected with a blowing head 14'. Both levers 28 have a guiding slot 29 for guiding pins 30 which are mounted on a holding part 21 connected with the air guiding pipe 11. A return spring 22' surrounds a flexible hose piece 13' which connects the blowing head 14' with the air guiding pipe 11. Thereby the return spring 22' serves simultaneously as protection for the flexible hose piece 13'. The pulling rope 23 is guided over the guiding path 21 and is connected with its end to a pin 31. The pin 31 connects both coulisse levers 28 with one another. In this embodiment also the blowing nozzle 14' can be turned over a region of 90° .

Instead of the pulling rope, the turnably supported blowing head 14 can also be coupled with the handle 12 through a linkage with an operating turning lever 27. By means of a second pulling rod engaging at another location the blowing head 14 or adjusting linkage and with an adjusting lever which is adjustable not only in one plane, also a spatial adjustment of the blowing nozzle 14 can be obtained Its adjusting movement is not limited to only one adjusting plane.

Figure 5:
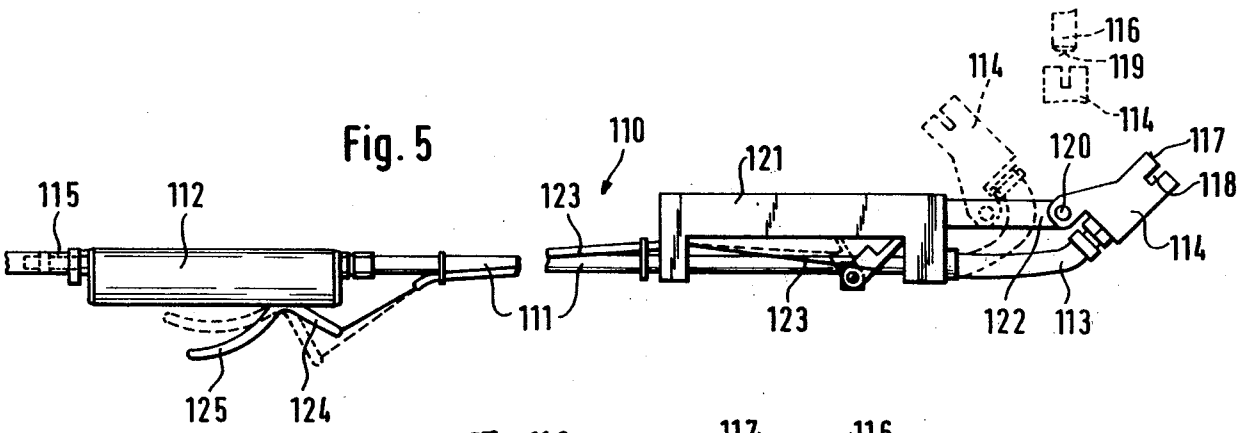
FIG. 5 is a side view of the pressure air tool in accordance with the third embodiment of the invention.

A pressure air tool shown in FIG. 5 has an air guiding pipe 111. A handle 112 is mounted on one end of the air guiding pipe, and a blowing nozzle 114 is mounted on the other end through a flexible hose piece 113. A pressure air supply connection 115 is formed on the handle 112. The blowing nozzle 114 has at its free end a blowing opening 117 provided with radially extending slots 118. In the slots 118, a thread is introduced and must be blown into an opening 119 of a thread guiding pipe 116 shown in FIG. 5.

The blowing nozzle 114 is arranged turnably and for this purpose is connected on a hinge point 112 with an adjusting pipe 122 which is longitudinally displaceable in a housing 121. The housing 121 is mounted on the front end portion of the air guiding pipe 111. The adjusting pipe 122 is coupled with a Bowden rope 123 which leads to an arm 124 turnably supported on the handle 112. The arm 124 is turnable by means of a gripping lever 125.

Figure 8:
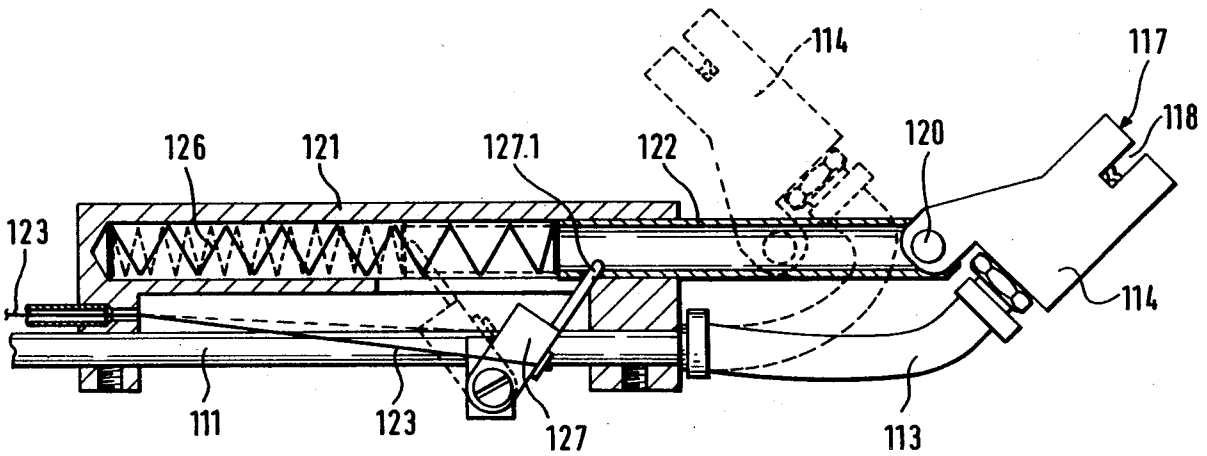
FIG. 8 is a view showing a blowing head region of the pressure air tool, partially in section on an enlarged scale.

As shown in FIG. 8, the adjusting pipe 122 can be displaced by means of the Bowden rope 123 against the force of a helical pressure spring 126 arranged in the housing 121. The end of the Bowden rope engages with a turnable arm 127 which is arranged on the air guiding pipe 111. The turnable arm 127 is coupled with one end 127.1 with the guiding pipe 122.

Figure 6:
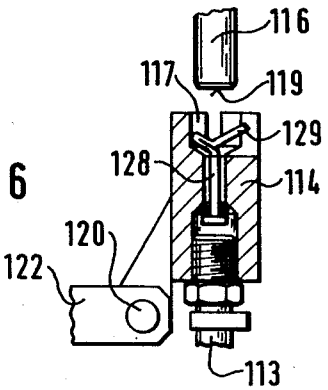
FIG. 6 is a longitudinal section through the blowing head of the pressure air tool, on an enlarged scale and with a closed pressure air valve.
Figure 7:
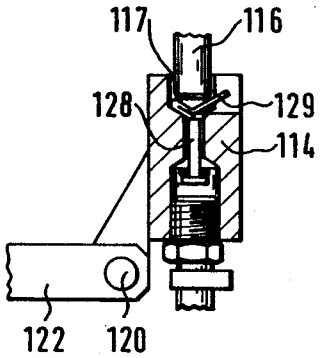
FIG. 7 is a view corresponding to the view of FIG. 6 but showing the pressure air tool with an open pressure air valve.

The air supply to the blowing head is performed from a pressure air supply connection 115 through the air guiding pipe 111 and the flexible hose piece 113 to the blowing nozzle 114. As shown in FIGS. 6 and 7, a pressure air valve with a plunger-like closing member 128 is formed in the blowing nozzle 114. The closing member 128 is connected with a sensor 129. This sensor extends to the blowing opening 117 which is formed as a receiving space for the end of a thread guiding 116.

During placing the blowing head 114 against the opening 119 of a thread guiding pipe 116, the end of the thread guiding pipe 116 dips into the opening 117 of the blowing head 114 and strikes against the sensor 128. The sensor 128 is moved into the blowing head 114. Thereby the plunger-shaped valve member 128 is lifted from a valve seat, so that the pressure air valve opens and the pressure air can escape through the blowing head opening 117 into the thread guiding pipe 116. As long as the blowing head 114 is again lifted from the thread guiding pipe, the pressure air valve closes under the action of the increasing pressure.

It will be understood that each of the elements described above, or two or more together, may also find a useful application in other types of constructions differing from the types described above.

While the invention has been illustrated and described as embodied in a pressure air tool for blowing threads in thread guiding pipes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A pressure air tool for blowing threads into thread guiding pipes and comprising an air guiding pipe having opposite ends; a blowing head pivotably supported at one of said opposite ends of said air guiding pipe; a handle mounted on the other of said opposite ends of said air guiding pipe; and means for adjusting a position of said blowing head at said one of said opposite ends of said air guiding pipe, said adjusting means comprising a hand adjusting element supported on said handle and means for drivingly connecting said hand adjusting element with said blowing head, said blowing head including an end surface having a blowing opening and a plurality of slots extending radially of said blowing opening for receiving threads to be blown into a thread guiding pipe.

2. A pressure air tool as defined in claim 1 wherein said blowing head includes a valve for controlling air flow through said blowing opening and having a closing member which opens automatically in response to placing said blowing head against an end of the thread guiding pipe.

3. A pressure air tool as defined in claim 2, wherein said blowing head has an opening which is formed so as to receive the end of the thread guiding pipe; and further comprising a sensor which is coupled with said closing member and actuatable by the end of the thread guiding pipe.

4. A pressure air tool for blowing threads into thread guiding pipes and comprising an air guiding pipe having opposite ends; a blowing head pivotably supported at one of said opposite ends of said air guiding pipe; a handle mounted on the other of said opposite ends of said air guiding pipe; means for adjusting a position of said blowing head at said one of said opposite ends of said air guiding pipe, said adjusting means comprising a hand adjusting element supported on said handle and means for drivingly connecting said hand adjusting element with said blowing head, said blowing head including an end surface having a blowing opening and a valve for controlling air flow through said blowing opening and having a closing member which opens automatically in response to placing said blowing head against an end of the thread guiding pipe; and a sensor coupled with said closing member and actuatable by the end of the thread guiding pipe.

* * * * *